United States Patent [19]

Wu

[11] Patent Number: 5,018,055

[45] Date of Patent: May 21, 1991

[54] BENDABLE AND DEFORMABLE LAMP STRING COMBINATION

[76] Inventor: Jeng-Shyong Wu, No. 123, Tung Hsing Road, Tou Fen, Miao Li Hsien, Taiwan

[21] Appl. No.: 290,957

[22] Filed: Dec. 28, 1988

[51] Int. Cl.[5] ..... F21V 21/00

[52] U.S. Cl. ..... 362/238; 362/249; 362/396

[58] Field of Search ..... 362/238, 249, 252, 396, 362/806

[56] References Cited

U.S. PATENT DOCUMENTS

| | | | |
|---|---|---|---|
| 3,633,023 | 1/1972 | Castiglioni et al. | 362/249 X |
| 4,204,273 | 5/1980 | Goldberg | 362/238 X |
| 4,335,422 | 6/1982 | Van Ess | 362/396 X |

*Primary Examiner*—Stephen F. Husar

*Attorney, Agent, or Firm*—Schwartz & Weinrieb

[57] ABSTRACT

This invention relates to a bendable and deformable lamp string combination comprising a pipe or a corrugated spring or a bendable tube interfaced with a spiral string to form a foldable ladder mutually joined by an elastic hinge for the accommodation of a lamp string either in series or in parallel. More particularly, the corrugated spring can be divided into several units connected to its respective lamp adapter, and consequently, the foldable ladder becomes interchangeable with respect to its lamp string and lamp adapter either in formation or in length, and is further characterized in that, it can be bent or deformed to the desired patterns or characteristics and can be joined to the inner or outer flange of a door and window to form a very convenient, eye-catching and beautiful lamp string combination.

8 Claims, 4 Drawing Sheets

FIG. 1A
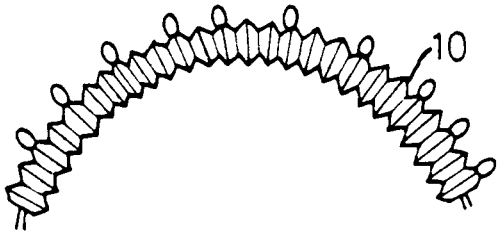
FIG. 1B
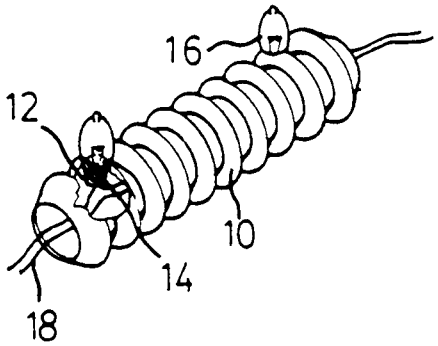
FIG. 2A
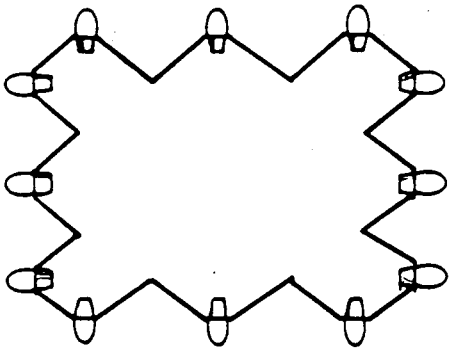
FIG. 2B
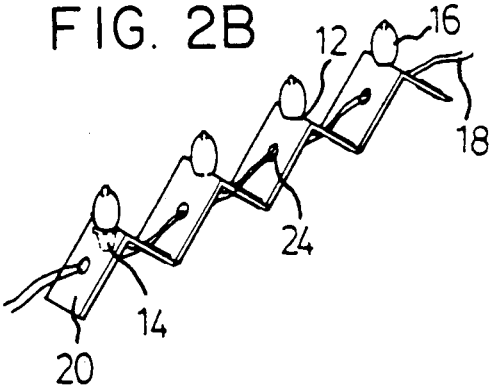
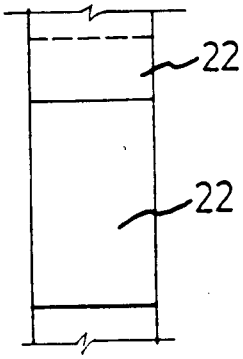
FIG. 3
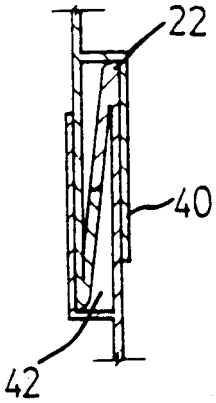
FIG. 4

FIG. 5A
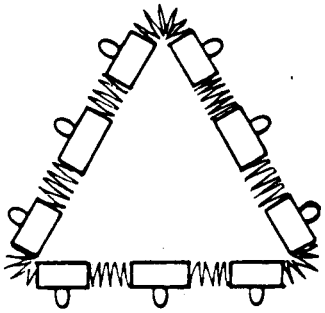
FIG. 5B
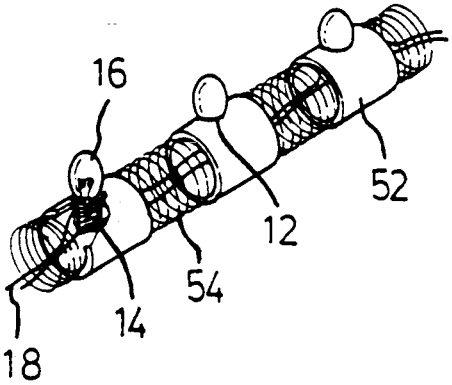
FIG. 6A
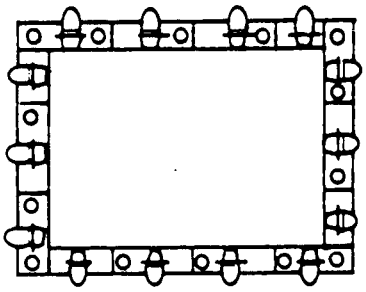
FIG. 6B
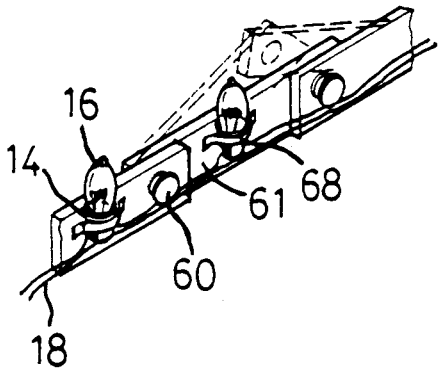
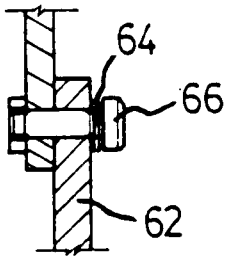
FIG. 7
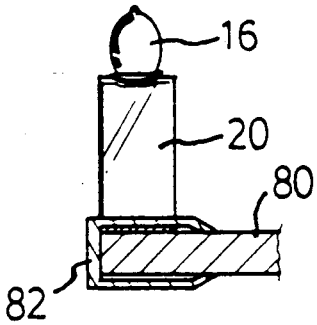
FIG. 8

BENDABLE AND DEFORMABLE LAMP STRING COMBINATION

FIELD OF THE INVENTION

This invention relates to a lamp string combination which can be bent at any angle to form any pattern and character for advertising or decoration.

BACKGROUND OF THE INVENTION

All the street signs or lamp combinations used in the occasions of ceremonies or entertaining locations can be generally classified into two categories, that is, one requires a power supply, such as, for example, the neon light; or acrylic sign boards lighted by fluorescent lamps, while the other does not require a power supply, such as, for example, sign board simply for dedication purposes. However, the lamp strings or neon light tubes in corresponding sizes are nevertheless indispensable.

The neon light tubes are manually bent in accordance with the desired characteristics or designs. However, prior to the manual bending process, the tube must be heated up, and, in case there are too many locations to be bent, the electricity is not always conducted to all portions of the light system. In addition, since the length of the neon light tube must be in a fixed relationship with respect to the secondary high-voltage of the transformer at the power supply (approximately 1,000 V required for each meter), and since each tube comprising the neon light is constructed with a predetermined length whereby the same is unable to be limited in size, the system is unable to distribute a reduced amount of the secondary voltage from the transformer of the power source to the tubes, such that, the application of such neon lights within the system causes high power consumption.

Another application of such lamps is to apply the lamps either in series or in parallel around the periphery of a given pattern or a given character to allow the lamps to blink with different intervals given to each lamp. This method of application not only lacks flexibility for variety but also becomes very tedious in production since a fixed model must first be used, whereby the total weight is increased and the installation becomes more difficult. Consequently, it is not applicable when a large scale and diversified display are required.

OBJECTS OF THE INVENTION

Accordingly, a lamp string combination system which can be bent to form varied patterns and character is still in need.

The main purpose of this invention is to utilize a lamp string combination which can be bent and wound for the production of patterns and/or characters pre-designated in a simple manner without a prefabricated model.

Another purpose of this invention is to provide the lamp string combinations which are interchangeable and can be joined so as to form lamp strings of different lengths based on actual requirements without being subjected to length or insufficient voltage requirements or problems.

Furthermore, this invention is constructed to provide lamp string combinations which can be joined to devices such as a frame, door and window upon their inner or outer flanges for flexible displacement or routing thereof.

The final purpose of this invention is to offer a power saving device within a lamp string combination where the whole operation can be achieved by simply using a general power receptacle.

SUMMARY OF THE INVENTION

In order to achieve the above purpose and those others not mentioned herein, the bendable and deformable lamp string combination as provided by this invention mainly comprises a windable, plastic coiled pipe or a corrugated spring or a spring tube combination interfaced with a spiral spring or with an elastic hinge to be mutually joined for the formation of a foldable ladder for the distribution of lamp strings either in series or in parallel. The corrugated spring can be divided into several sections with components to be joined with their own respective lamp adapters, and consequently, the foldable ladder is deformable with respect to both the spring and the adapter, and the lengths of the lamp string combinations can also be changed by changing the lamps with the strings. The aforesaid bendable and deformable lamp string combination is characterized in that it can be bent into the patterns and characters as required and it can be secured to various bases or door panels with C-type buckles so as to become a very beautiful and eye-catching lamp string combination.

BRIEF DESCRIPTION OF THE DRAWINGS

For those who are familiar with this art, the aforesaid and other purposes, features and advantages of the present invention will become more readily apparent from the following description of the illustrated embodiments of the present invention taken in conjuction with the accompanying drawings, in which:

FIG. 1 is a view of the first example of this invention with its blow-out.

FIG. 2 is a view of the second example of this invention with its blow-out.

FIG. 3 is a front view of the joints for each unit for the second example of this invention.

FIG. 4 is a side view of the joints for each unit for the second example of this invention.

FIG. 5 is a view of the third example of this invention with its blow-out.

FIG. 6 is a view of the fourth example of this invention with its blow-out.

FIG. 7 is partial sectional view of the fourth example of this invention.

FIG. 8 is a view of an example of a C-shaped clamp of this invention.

DETAILED DESCRIPTION OF THE PREFERRED EMBODIMENTS

Figure 9A:
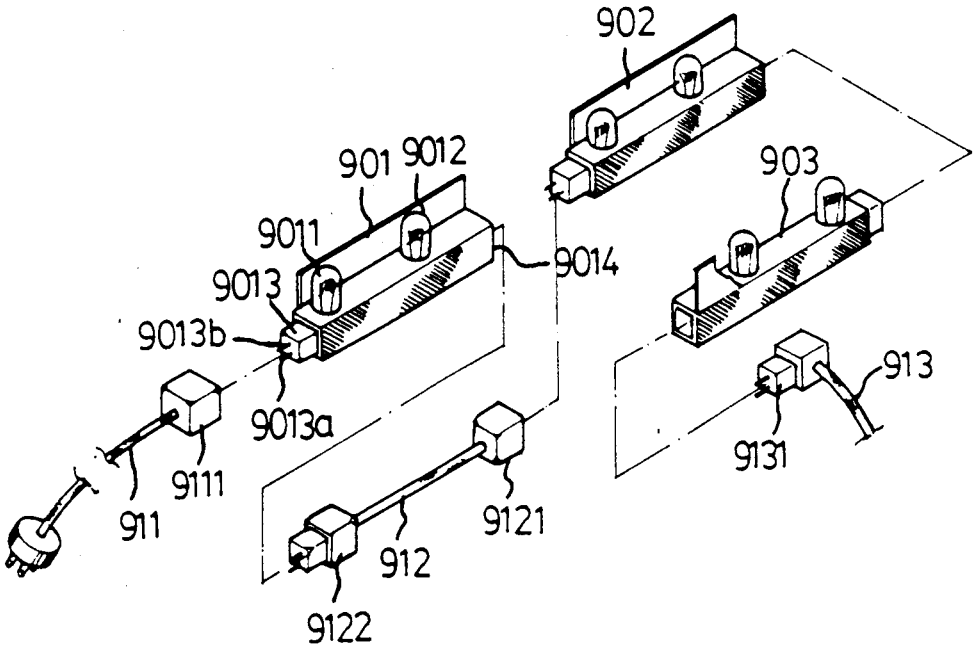
FIGS. 9A and 9B are views of the fifth example of this invention.

With reference to FIG. 1, the first example of the application of this invention is shown, where the pattern formed by bending the windable lamp combination utilizes a hole 12 provided at a proper position on the plastic hollow coil 10, with a lamp seat 14 placed within each hole 12, and conductive wires 18 either in series or in parallel penetrate through the hollow plastic coil 10 to allow the bulbs 16 to be disposed upon the outside of the coil 10, with the lamp seat 14 and wires 18 fixed inside, the plastic coil 10 can then be bent into various shapes based on the different patterns or characters desired or required.

Referring now to FIG. 2 to FIG. 4, these figures show the front view and side view of the joint 22 for each unit indicated in the second example offered by this invention. Within the square pattern shown in FIG. 2 there is provided a corrugated spring 20, whereupon hole 12 is provided within each wave peak; the lamp seat 14 is placed between wave troughs and the conducting wires 18 penetrate the round-shaped hole 24 of each slanting plane between each two waves; while a bulb 16 is disposed within the hole opened at the wave peak; as a result, such lamp string can still be clearly displayed no matter what pattern or character it has been bent into. In FIG. 3 and FIG. 4, the lamp string combination manufactured from such spring 20 can be combined in units while at each end of each unit is a hook shaped joint 22, and a square shaped protective bracket 40 is provided at the proper location allowing the hooked head to be hooked with a respective hook hole 42 and joined therewith. As both corresponding joints 22 are coupled, the lamp string combination made of spring 20 can be extended and bent without any limitation.

As shown in FIG. 5, the lamp string has been bent into the form of a triangle in accordance with the third example of the lamp string combination provided by this invention which includes the interspaced tube 52 and the spiral spring set 54. By using the extension capacity from the spiral spring set 54 and the hollow short cut tube 52, the lamp string is placed inside the tube 50 to form such pattern, the hole 12 is made available on each section of the hollow tube 52, the lamp base 14 and wires 18 are placed within the hollow tube, and bulb 16 is disposed within lamp base 14 through hole 12, with wire 18 penetrating within the hollow tube 52 and within the spiral spring 54. As a result, any shape or character can be achieved as desired.

FIG. 6 and FIG. 7 show the fourth example of the lamp string combination provided by this invention and in particular a sectional view of the portion at the bend or corner location thereof. The windable lamp string combination in this example is formed by several thin plates 62 hinged together with lamp seat 14 fixed onto each thin plate 62 by means of fixing strap 68, and the lamp bulb 16 is disposed within lamp seat 14. In bending and folding the lamp string, each hinge 60 can be deformed depending on the necessary situation, and the foldable ladder 61 can be replaced or extended for proper length as required. Consequently its length will not be limited, particularly in view of the fact that at each bending location of such foldable ladder, there is disposed a resilient hinge 60. FIG. 7 shows the sectional view of such resilient hinge 60, wherein, the torsional spring 64 having its one end fixed onto thin plate 62 and another end fixed to bolt 66, when two connected thin plates 62 are bent out of alignment with respect to each other, a single biasing force will be exerted by the spring 64, such that the foldable ladder 61 can be bent or returned to its original shape.

With reference to FIG. 8, wherein, the C-type clamp is connecting the lamp assembly of this invention to base plate 80, the base plate 80 can be the outer flange of any frame, door, or window. As shown in FIG. 8, simply by using the C-type clamp 82 with its two leg members to encompass the wave trough from such corrugated spring 20 and such base plate 80, when the spring 20 lamp string combination is fixed on the above mentioned base plate 80 and the two leg members tightly inserted in the base plate, the lamp string combination will be fixed; however, such C-type clamp 82 is applicable to any type of bendable and deformable lamp string combination.

Figure 9B:
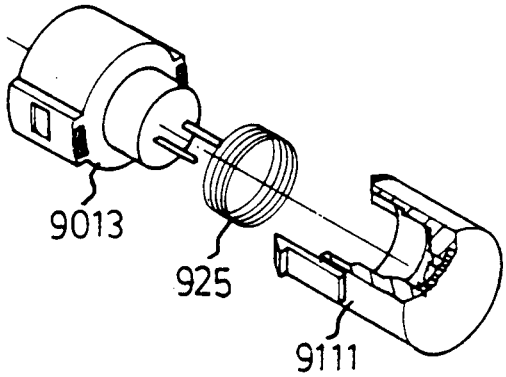

Another example available for this invention is shown in FIG. 9A, wherein the lamp for hanging purposes is composed of multiple bulb seats 901, 902, 903 and the connecting bodies 911, 912 connected to lamp bulb seats 901, 902, wherein, the bulb seats 901, 902 . . . are the seat bodies. The sliding or fixed bulbs 9011, 9012 . . . are put on to the bulb seats, and the two ends of bulb seats 901, 902 are formed with a plug 9013 with pins 9013*a*, 9013*b* and a receptacle 9014 with receiving holes 9014*a*, 9014*b* respectively. The windable connecting pipes 911, 912, 913 with the receptacle and/or plug 9111, 9121, 9122 and 9131 at the ends thereof are used for the connection with lamp seats 901, 902, 903 axial extent and the receptacles or plugs at the ends of the windable connection pipes 911, 912 and 913 can be formed at different angles, and furthermore, the construction between two receptacles and plugs can be made as shown in FIG. 9B with the receptacles 9111 . . . and plugs 9013 . . . having circular end configurations, the spring 925 is placed inside each of the receptacle and plug, and, by using the concave and convex latching means, the recetacle and plug can be buckled together.

Figure 10A:
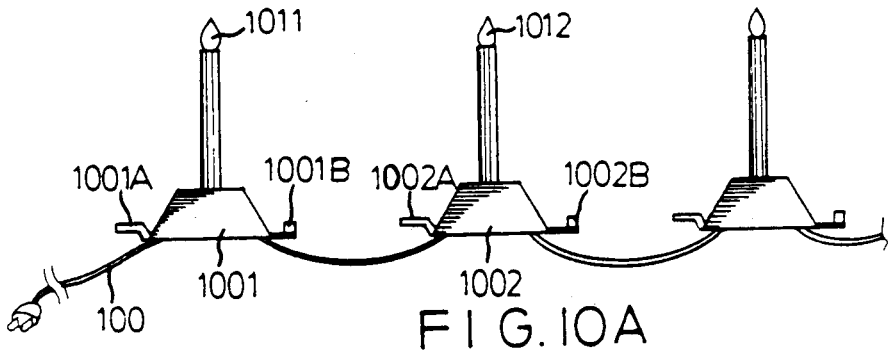
FIGS. 10A, 10B, and 10d are views of the sixth example of this invention.
Figure 10B:
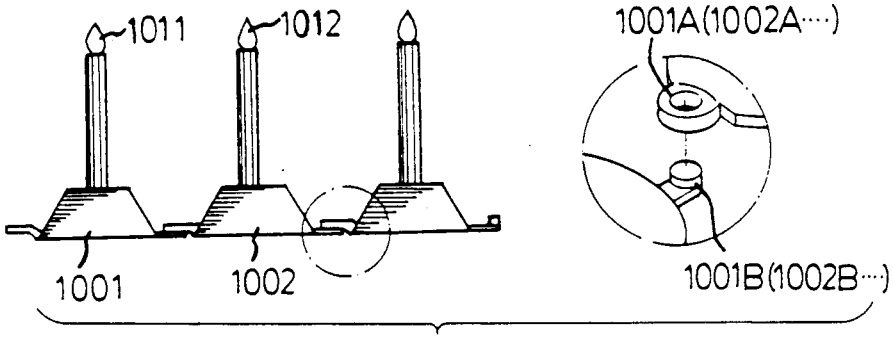

As shown in FIG. 10A, in a further example of this invention, the bulb seat 1001 and 1002 is formed as a disk bottom with a hollow erected post extending downwardly, while at the top end of such erected post, there is a bolting hole extending downwardly to secure the bulbs 1011, 1012 . . . onto the top end of the erected post. Upon the flange of each disk, there is formed a pair of buckled bodies 1001A–1001B, 1002A–1002B, . . . . The power line 100 can penetrate the bulb seats 1001, 1002 . . . to connect the bulb seats in series. More particularly, the abutted bodies of 1001A–1001B; 1002A–1002B . . . are formed in complimentary pairs comprising posts and latching holes or apertures whereby the bulb seats 1001, 1002, . . . can be individually connected to electric wires, or can be connected by the buckling bodies of 1001A, 1001B . . . in a straight line as shown in FIG. 10B.

Figure 10C:
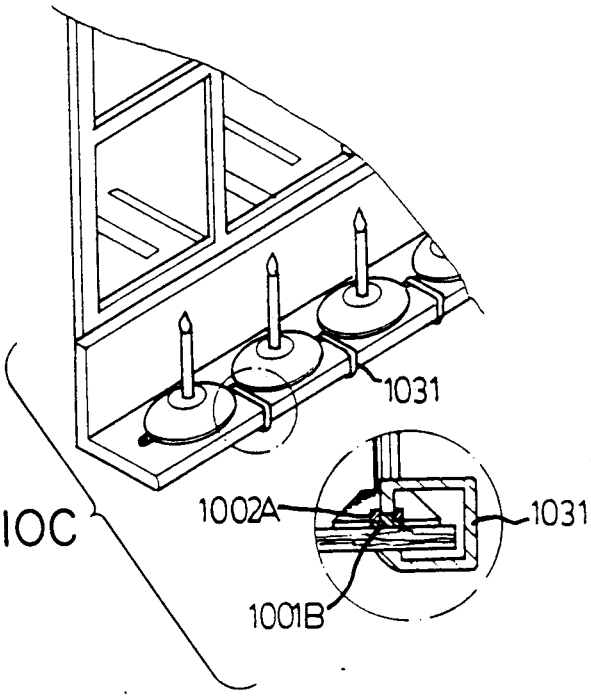

The preferred embodiment of the above bulb seats 1001, 1002, . . . is to be placed on a flat and straight plate such as on window and door frames, by using the fixing clamps 1031 . . . accordingly, the window frame with the bulb seats can be clamped and as shown in FIG. 10C, as a result the bulbs can form a lamp string with different patterns.

It is thus seen that this invention relates to a bendable and deformable lamp string combination mainly by using several kinds of windable materials for a lamp shelf with the lamp string either in series or in parallel. It will simplify the task of bending the lamp string into certain patterns or characteristics and render the same free from any limitations of length. Furthermore, such bendable lamp string combination can use C-type clamps to join the same to any outer flanges, such as those upon any frame, door, and window such that the lamp string combination serves as an eye-catching lamp decoration serving the purposes of advertisement, or general celebration and entertaining occasions.

All these practical examples are used for the detailed explanation for the purpose, features and performances of this invention and for those who have expertise in this art, with the description given above, many alternatives and revisions can be expected to be developed without getting away from the scope of the spirit of this invention.

I claim:

1. A bendable and deformable string lamp combination, comprising:

a tubular support member defined about a longitudinal axis and having a predetermined longitudinal extent, a predetermined lateral extent, and defining a hollow space therewithin, and including means for permitting said tubular support member to be bent along said longitudinal extent thereof so as to pre-selectively alter the direction in which said tubular support member extends;

a plurality of illumination lamps mounted upon said tubular support member so as to extend laterally beyond said lateral extent of said tubular support member; and electrical power wiring means, for providing electrical power to said plurality of illumination lamps, disposed internally within said tubular support member so as to extend within said hollow space and along said longitudinal extent of said tubular support member.

2. A string lamp combination as set forth in claim 1, wherein:

said tubular support member comprises a hollow plastic pipe; and said electric power wiring means is disposed internally within said hollow plastic pipe.

3. A string lamp combination as set forth in claim 1, wherein:

said tubular support member comprises a plurality of axially spaced cylindrical tubular members, and a plurality of axially spaced coil spring members respectively interconnecting said plurality of axially spaced cylindrical tubular members; and said electrical power wiring means is disposed internally within said axially spaced cylindrical tubular and axially spaced coil spring members.

4. A string lamp combination as set forth in claim 2, further comprising:

means defining apertures within sidewall portions of said hollow plastic pipe for mounting said illumination lamps such that said illumination lamps project radially outwardly with respect to said hollow plastic pipe.

5. A string lamp combination as set forth in claim 3, further comprising:

aperture means defined within sidewall portions of said axially spaced cylindrical tubular members for mounting said illumination lamps such that said illumination lamps project radially outwardly with respect to said cylindrical tubular members.

6. A string lamp combination as set forth in claim 1, wherein:

said tubular support member comprises a plurality of axially spaced tubular members having a configuration which is substantially that of a rectangular parallelepiped, each of said tubular members being hollow;

aperture means defined within sidewall portions of said hollow rectangular parallelepiped members for mounting said illumination lamps; and electrical male and female plug means mounted within respective end portions of said plurality of hollow rectangular parallelepiped members for electrically interconnecting said plurality of hollow rectangular parallelepiped members in a serial manner.

7. A string lamp combination as set forth in claim 6, wherein:

said male and female plug means have substantially cubical configurations.

8. A string lamp combination as set forth in claim 6, wherein:

said male and female plug means have substantially cylindrical configurations.

* * * * *